United States Patent [19]

Dilo

[11] Patent Number: 4,631,789

[45] Date of Patent: Dec. 30, 1986

[54] APPARATUS FOR THE PRODUCTION OF NEEDLED, SHAPED FIBROUS BODIES

[75] Inventor: Richard Dilo, Eberbach, Fed. Rep. of Germany

[73] Assignee: Oskar Dilo Maschinenfabrik KG, Eberbach, Fed. Rep. of Germany

[21] Appl. No.: 550,449

[22] Filed: Nov. 10, 1983

[30] Foreign Application Priority Data

Nov. 23, 1982 [DE] Fed. Rep. of Germany ..... 3243326

[51] Int. Cl.[4] ..... D04H 18/00

[52] U.S. Cl. ..... 28/107

[58] Field of Search ..... 28/107–115, 28/289; 19/148

[56] References Cited

U.S. PATENT DOCUMENTS

| | | | |
|---|---|---|---|
| 1,056,896 | 3/1913 | Fischman | 19/148 |
| 1,510,236 | 9/1924 | Maussner et al. | 28/107 |
| 2,004,544 | 6/1935 | Waters et al. | 28/113 |
| 2,158,533 | 5/1939 | Cavey | 28/112 |
| 2,463,759 | 3/1949 | Fitch | 19/148 |
| 2,971,243 | 2/1961 | Burns | 28/289 |
| 3,044,146 | 7/1962 | Thomas et al. | 28/107 |
| 3,177,275 | 4/1965 | Brenner | 19/148 |
| 3,649,400 | 3/1972 | Sowaki et al. | 28/109 |
| 3,707,838 | 1/1973 | Dorschner et al. | 28/112 |
| 3,717,905 | 2/1973 | Furbeck | 19/148 |
| 3,849,223 | 11/1974 | Kent | 28/109 |
| 3,856,602 | 12/1974 | Colijn et al. | 28/109 |
| 4,392,286 | 7/1983 | Yakushiji et al. | 28/289 |

FOREIGN PATENT DOCUMENTS

| | | | |
|---|---|---|---|
| 2911762 | 10/1980 | Fed. Rep. of Germany | 28/107 |

OTHER PUBLICATIONS

Man-Made Textile Encyclopedia; Copyright date 1959; publishers: Textile Boor Publishers, Inc., p. 494.

*Primary Examiner*—Robert R. Mackey
*Assistant Examiner*—Joseph S. Machuga
*Attorney, Agent, or Firm*—Rosen, Dainow & Jacobs

[57] ABSTRACT

Apparatus for producing needled fibrous bodies of a predetermined geometrical shape and height or strength of fiber material, particularly as padding elements for the clothing industry.

6 Claims, 4 Drawing Figures

FIG. 2
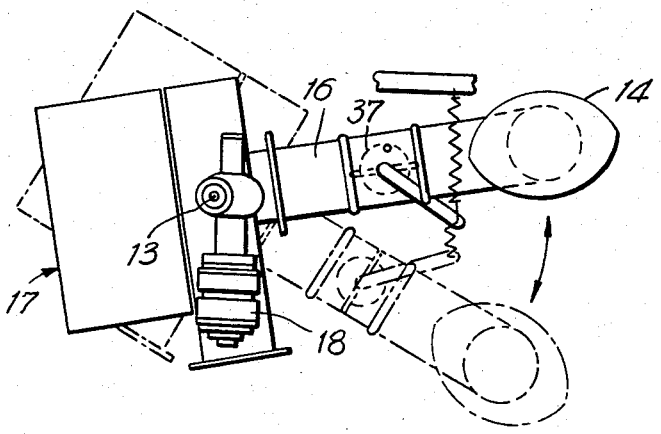
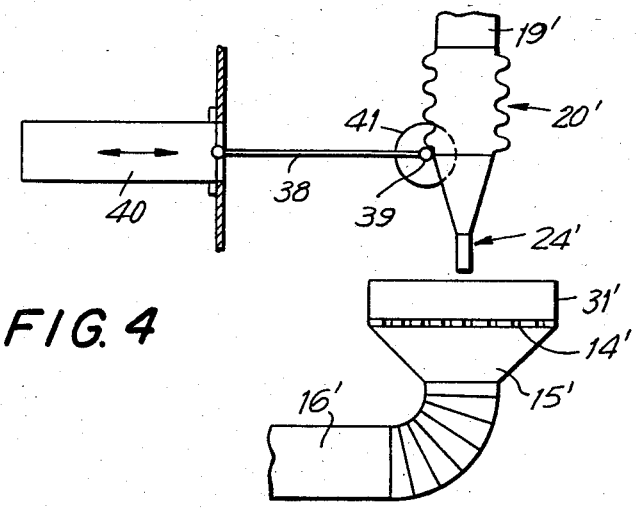
FIG. 4

APPARATUS FOR THE PRODUCTION OF NEEDLED, SHAPED FIBROUS BODIES

BACKGROUND OF THE INVENTION

The invention relates to a device for the production of needled fibrous bodies of a determined geometric form and height or strength of fibrous material, which are particularly used for padding elements in the clothing industry.

Fibrous bodies of the type in question have hitherto been produced with relatively high expenditure using a lot of hand work.

SUMMARY OF THE INVENTION

The invention is based on the task of providing an apparatus which enables the production of automatically needled fibrous bodies which are formed in a predetermined manner regarding their external geometric shape on the one hand and regarding their height or strength along any cross section on the other hand. Such fibrous bodies are for example used as shoulder padding in clothing. Usually these shoulder pads are produced in pairs where a fibrous body is required with approximately elliptical base surface, the fiber material height is slight on the area of the periphery and increases towards the center in a particular manner.

For solving this task the invention suggests forming the device in question as follows:

(a) a perforated table is moveably or pivotably arranged between two positions, serving as a bearing surface for the fibers deposited on it as well as a supporting plate in the needling of the fiber heap;

(b) above the one position of the perforated table there is a nozzle arranged on the bottom end of a vertical pipe or tube for the passing out of an air flow containing the fibers forming the fibrous body. The nozzle is mounted in a manner adjustable towards the perforated table;

(c) beneath the perforated table there is arranged an air-tight housing which is connected to a vacuum source via a pipe or tube;

(d) above the perforated table in the other position, there is a needling device of a per se known design with vertically moveable needle board, the needles of which being so arranged that they correspond to the holes in the perforated table.

The nozzle out of which the air flow passes with the fibers is preferably designed in the form of a slotted nozzle rotatable about a vertical axis. The cross section of this slotted nozzle is so formed that the fibers laid on the perforated table through the air flow, form a heap of fibers of the desired form and size.

It is however also possible to connect the nozzle to drive means which move the nozzle, with which it can be moved parallel to the perforated table in two right angled directions. The driving means are controlled through a suitable control unit in such a way that also a heap of fibers is formed of the desired form and size. The control device is respectively programmable so that the fiber heap is given the predetermined form and size, wherein preferably the formation of the heap of fibers is inspected through a sensor which corrects the control device accordingly.

BRIEF DESCRIPTION OF THE DRAWINGS

Further features and details of the device formed according to the invention can be seen from the following description of two preferred embodiments shown in FIGS. 1 to 4 of the drawings.

FIG. 2 is a view on the lower part of the machine with the perforated table moveable in two positions, FIG. 4 is a lateral view of the fiber depositing device in a second embodiment.

DETAILED DESCRIPTION OF THE DRAWINGS

Figure 1:
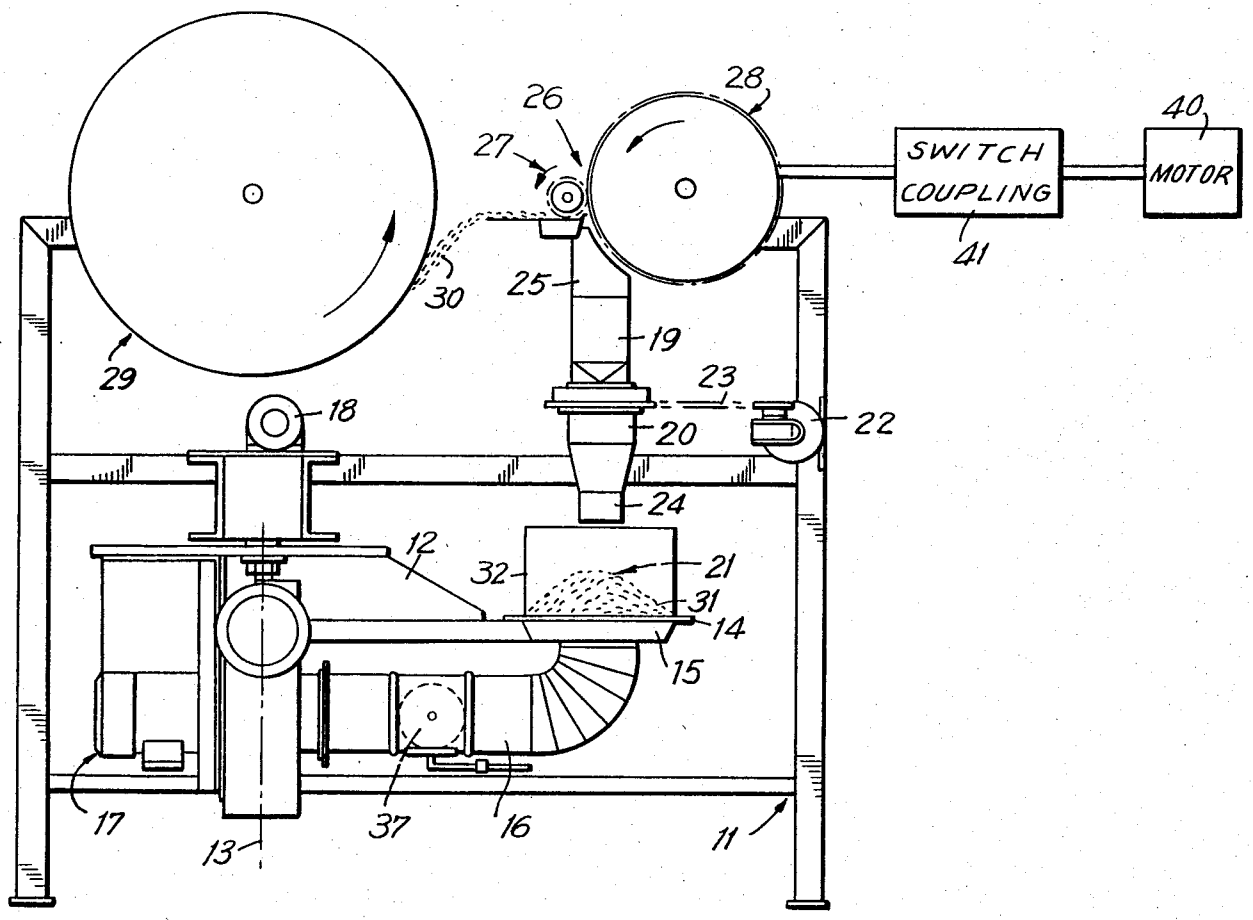
FIG. 1 is a lateral view of the apparatus for producing needled fibrous bodies of a predetermined form and size.

As FIG. 1 and FIG. 2 show, a swing arm 12 is mounted in a frame 11 of the apparatus about a vertical axis 13, reciprocable between two positions A and B. The swing arm 12 carries the perforated table 14 on its outer end beneath which a housing is situated which is connected to a suction air fan 17 via the pipe 16, in order to create a vacuum in the housing 15 beneath the perforated table 14. The swing arm 12 can be moved from one position into the other respectively via the drive 18.

In position A, above the perforated table 14 there is a pipe piece 19 mounted on the frame 11, the lower end 20 of which is rotatably mounted about the pipe axis 21. The rotating of the lower pipe piece 20 takes place via a controlled drive motor 22 via a chain drive 23. The lower free end of the lower pipe piece 20 is formed as a wide slotted nozzle 24. The upper end of the upper pipe piece 19 opens into a collecting container 25 of the fiber separating device 26 whose main components are the fiber fleece intake roller 27 and the associated break and scatter roller 28. Furthermore the roll 29 of webbed starting material is mounted on the frame, from which the web of material 30 is drawn off and fed to the fiber separating device 26 which breaks up the web of fibers. The scattering roller 28 rotating at a relatively high speed, having a saw tooth cutter as does the intake roller 27, separates the individual fibers of the fiber web 30 and produces an air flow which carries the fibers. The scattering roller 28 is driven by a motor 40 by way of a switch coupling 41. The air flow carrying the fibers passes from the collecting container 25 into the pipe pieces 19 and 20 where it finally passes out of the nozzle 24. It should be noted, however, that the width of the opening of the nozzle 24 may be varied along the length of the slot. During this step the air flow deposits the fibers onto the perforated table 14 in the form of a heap 31. This is supported through the fact that as a result of the vacuum in the housing 15 beneath the perforated table 14, the air is sucked through the fiber heap 31. Through rotating the wide slotted nozzle 24 in a predetermined manner, the fiber heap 31 can be given a determined, desired form. Expediently the fiber heap is surrounded by a casing 32 on the table 14 so as to prevent fibers being carried off unnecessarily through laterally escaping air.

Figure 3:
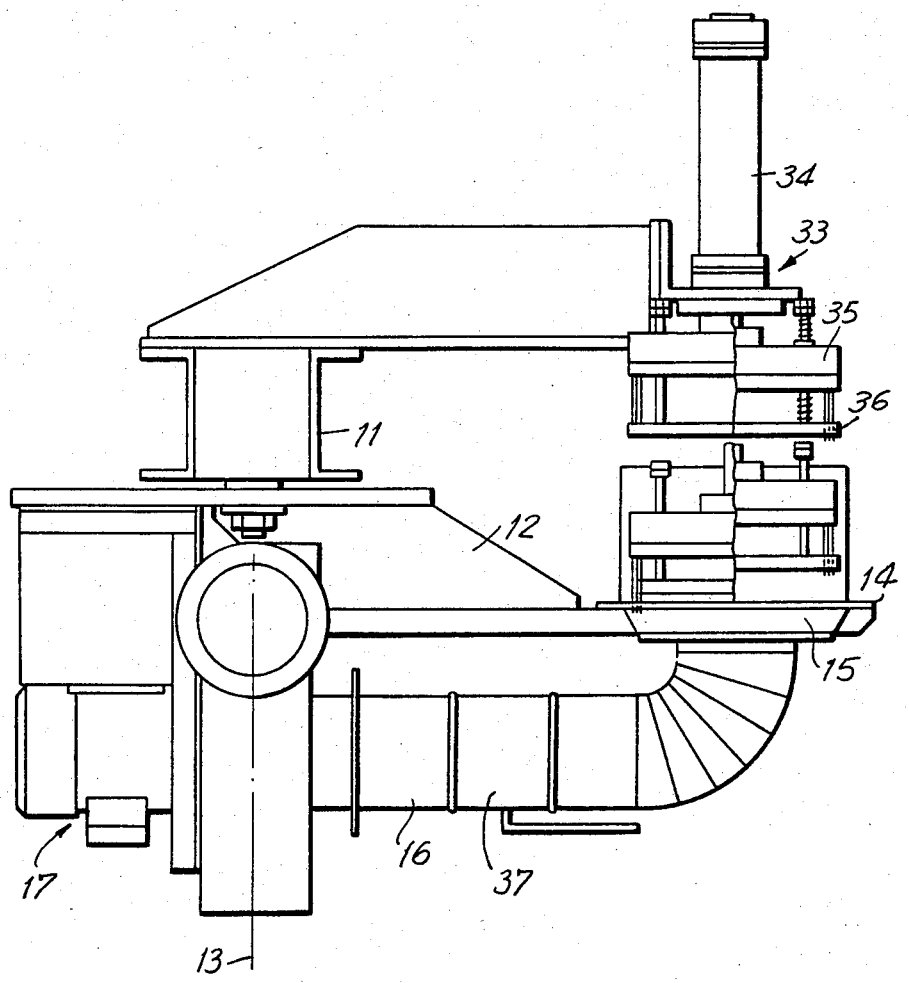
FIG. 3 is a lateral view of the apparatus with the needling means.

When the fiber heap 31 has been formed in the desired manner, the swing arm 12 is moved with the perforated table 14 out of position A into position B, wherein the perforated table 14 is positioned beneath the needling device 33, as shown in FIG. 3. Using the drive unit 34, the needle board 35 on which the stripping board 36 is mounted, is moved downwards towards the perforated table 14 which basically serves as a needle base plate. The openings in the perforated table thus correspond to the needles of the needle board 35.

After the fiber heap has been needled as desired on the perforated table, the needle board 35 is drawn up again. The needled fiber body remains on the needles protruding through the stripping board 36. After swinging back the swing arm 12 into position A the needle board is moved back further, where the needled, fibrous body on the stripping board 36, is drawn off the needles still holding it so that it can fall onto a delivery belt and be transported off. As soon as the perforated table 14 reaches the position A, the build-up of a new fiber heap can begin.

Advantageously there is a shut-off element 37 in the suction air line 16 for spontaneous break-off of the vacuum beneath the perforated table 14.

In the second embodiment shown in FIG. 4, the lower pipe piece 20' is of a flexible design. At the bottom end there is situated the nozzle 24' which, in this case, has a smaller cross section. Two guides 38, 39, arranged at right angles to each other grip onto the nozzle in a horizontal plane, each being coupled to a drive unit 40 or 41. These move the respective guides 38,39 in a certain manner forwards and backwards so that the opening of the nozzle 24' can be positioned over each point of the surface of the fiber body in order to build up the desired fiber heap 31' in the predetermined form and size. Otherwise the apparatus is the same as aforementioned.

What we claim is:

1. An apparatus for producing needled fibrous bodies of a predetermined geometrical form and height of fibrous material, particularly bodies used as padding elements in the clothing industry, comprising;

a perforated table with openings in its surface and movable between a first position A and a second position B;

a nozzle positioned above said perforated table at said position A for passing therethrough an air flow carrying individual fibers to form a fibrous heap on said table, said nozzle being movable enabling change of its position relative to said perforated table;

a tube, said nozzle being positioned at the end of said tube;

a vacuum casing and a pipe arranged beneath said perforated table, said casing being connected to a vacuum source via said pipe;

a needling device positioned to be above the perforated table when said table is in said position B, said needling device including a moving needle board having needles arranged to correspond with said openings in said perforated table; and means for moving said table between said positions A and B and said nozzle relative to said table.

2. An apparatus as claimed in claim 1, wherein said nozzle is slotted at its discharge opening and rotatable about a vertical axis.

3. An apparatus as claimed in claims 1 or 2, and further comprising a casing, said casing surrounding said perforated table at least in the area of said table wherein fibers from said nozzle are deposited.

4. An apparatus as claimed in claim 1 and further comprising a fiber separating device including a fiber collecting chamber, said tube for said air flow with said fibers being connected with said fiber collecting chamber for input of fibers to said tube.

5. An apparatus as claimed in claim 4, and further comprising a switch coupling and a drive motor for said separating device, said switch coupling being located between said separating device and said drive motor.

6. An apparatus as claimed in claim 1 and further comprising a shutoff element, said shutoff element being operatively positioned between said vacuum casing and said vacuum source.

* * * * *